United States Patent [19]

Stapleton

[11] 4,412,221

[45] Oct. 25, 1983

[54] ANTENNA SYSTEM FOR AIRBORNE TRANSCEIVER PROVIDING QUASI CONTINUOUS RECEPTION AND TRANSMISSION FREE FROM SHADOWING BY AIRCRAFT STRUCTURE

[75] Inventor: Brian P. Stapleton, Seattle, Wash.

[73] Assignee: The Boeing Company, Seattle, Wash.

[21] Appl. No.: 928,926

[22] Filed: Jul. 28, 1978

[51] Int. Cl.[3] ..... H01Q 1/28

[52] U.S. Cl. ..... 343/705; 343/708

[58] Field of Search ..... 343/705, 708, 786; 333/7 D

[56] References Cited

U.S. PATENT DOCUMENTS

| | | | |
|---|---|---|---|
| 2,598,064 | 5/1952 | Lindenblad | 343/876 |
| 3,004,153 | 10/1961 | Alford | 343/705 |
| 3,725,938 | 4/1973 | Black et al. | 343/705 |
| 3,922,685 | 11/1975 | Opas | 333/7 D |

*Primary Examiner*—David K. Moore

*Attorney, Agent, or Firm*—Conrad O. Gardner; Bernard A. Donahue

[57] ABSTRACT

One quarter wavelength monopoles on the top and bottom centerline of the aircraft fuselage provide hemispherical coverage for an airborne transceiver thereby reducing shadowing during maneuver. A solid state pair of PIN diodes capable of transmitting and receiving V.H.F. A.M. band energy are utilized in an antenna lobing switch circuit for alternating between antennas at a switching rate of 25 KHz.

1 Claim, 6 Drawing Figures

49
12
10
32
34
39
14
25
27
18
16
24
26
1MHZ CRYSTAL OSCILLATOR
÷40
21
XCVR
IN4001
35Ω 10W
1/2 AMP
LM309K
28VDC
IN5555
2300μf
.1μf
29

Fig. 2
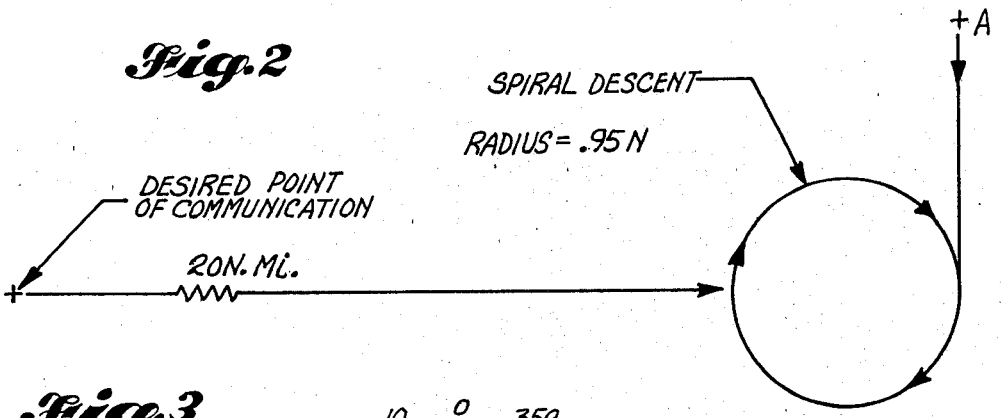
Fig. 3
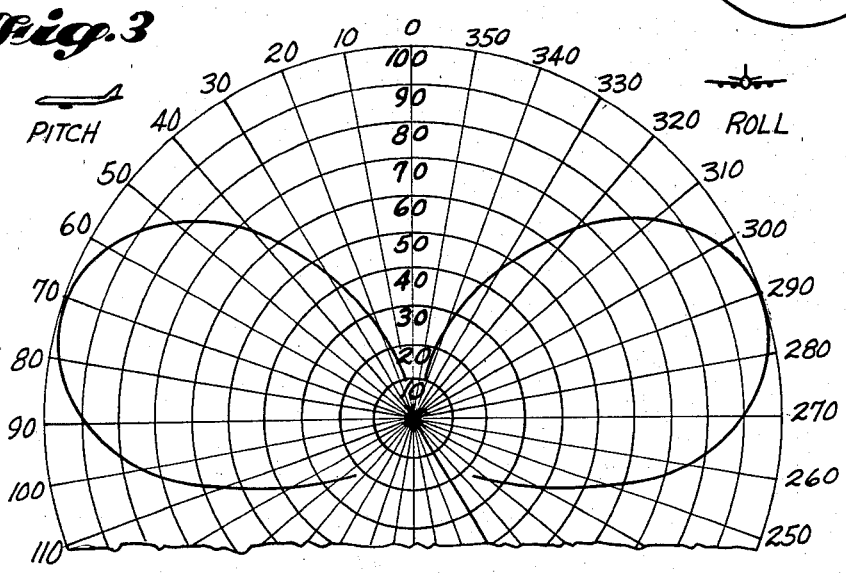
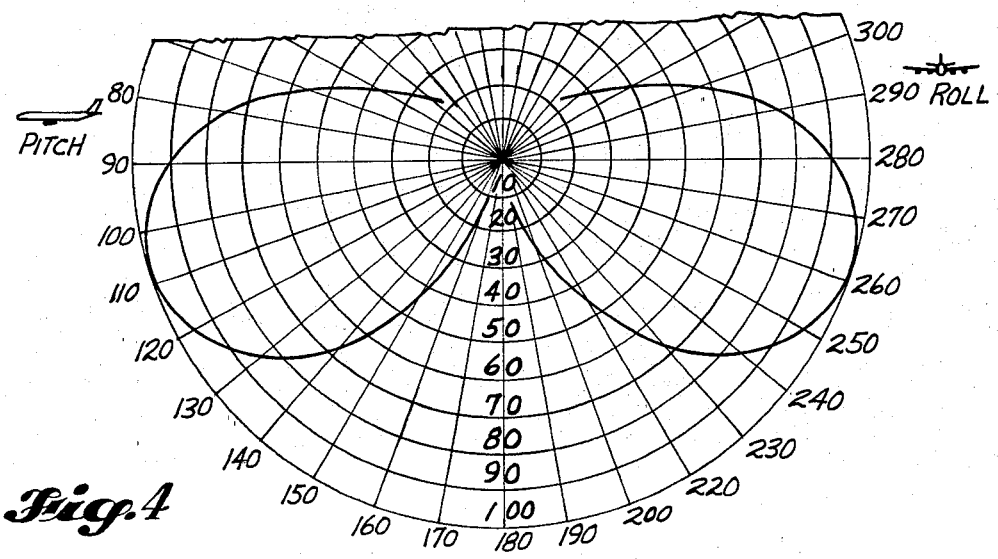
Fig. 4

ANTENNA SYSTEM FOR AIRBORNE TRANSCEIVER PROVIDING QUASI CONTINUOUS RECEPTION AND TRANSMISSION FREE FROM SHADOWING BY AIRCRAFT STRUCTURE

This invention relates to aircraft antenna systems and more particularly to aircraft antenna systems for providing hemispherical coverage.

Rotating antenna arrays positioned in back-to-back relation have been utilized at radar frequencies for providing hemispherical coverage as shown in U.S. Pat. No. 3,766,561.

Transmit-receive systems wherein differentially elevated antennas are alternately operated in transmitting or receiving modes through use of diodes utilizing square wave oscillator output signals are shown in FIG. 2 of U.S. Pat. No. 2,688,699. In U.S. Pat. No. 3,474,358 (column 4, line 39 et sequa and column 5, line 29 et sequa), a bi-directional lobing switch is shown which utilizes controlled PIN diodes selectively operated in either transmitting or receiving mode. U.S. Pat. Nos. 2,959,778, 3,117,241, and 3,452,299 show diode switch controlled transmit-receive devices while U.S. Pat. Nos. 3,568,097 and 3,922,685 are illustrative of transistor driven solid state diodes of the PIN type or the like.

It is accordingly an object of this invention to provide hemispherical coverage in an airborne antenna system utilizing lobing switching alternating between a top and a bottom fuselage centerline disposed omnidirectional antenna.

It is a further object of this invention to provide a switching rate of 25 KHz between first and second fuselage mounted antennas coupled to an airborne transceiver.

It is yet another object of this invention to provide an aircraft antenna system for reducing shadowing due to aircraft structure during communication intervals with the aircraft.

The above and other objects of the present invention are achieved in accordance with a preferred embodiment where a solid state lobing switch alternating between top and bottom centerline fuselage mounted antennas at a rate exceeding twice the highest audio frequency (approximately 3 KHz in V.H.F. A.M. systems) is coupled to an aircraft transceiver.

Further features and advantages of the invention will become apparent with reference to the specification and drawing wherein:

FIG. 2 is illustrative of a spiral descent flight path for the aircraft of FIG. 1;

FIG. 3 shows an antenna pattern for the top antenna mounted on a fuselage constant section on top centerline;

FIG. 4 shows an antenna pattern for the bottom antenna mounted on a fuselage constant section on bottom centerline;

Figure 1:
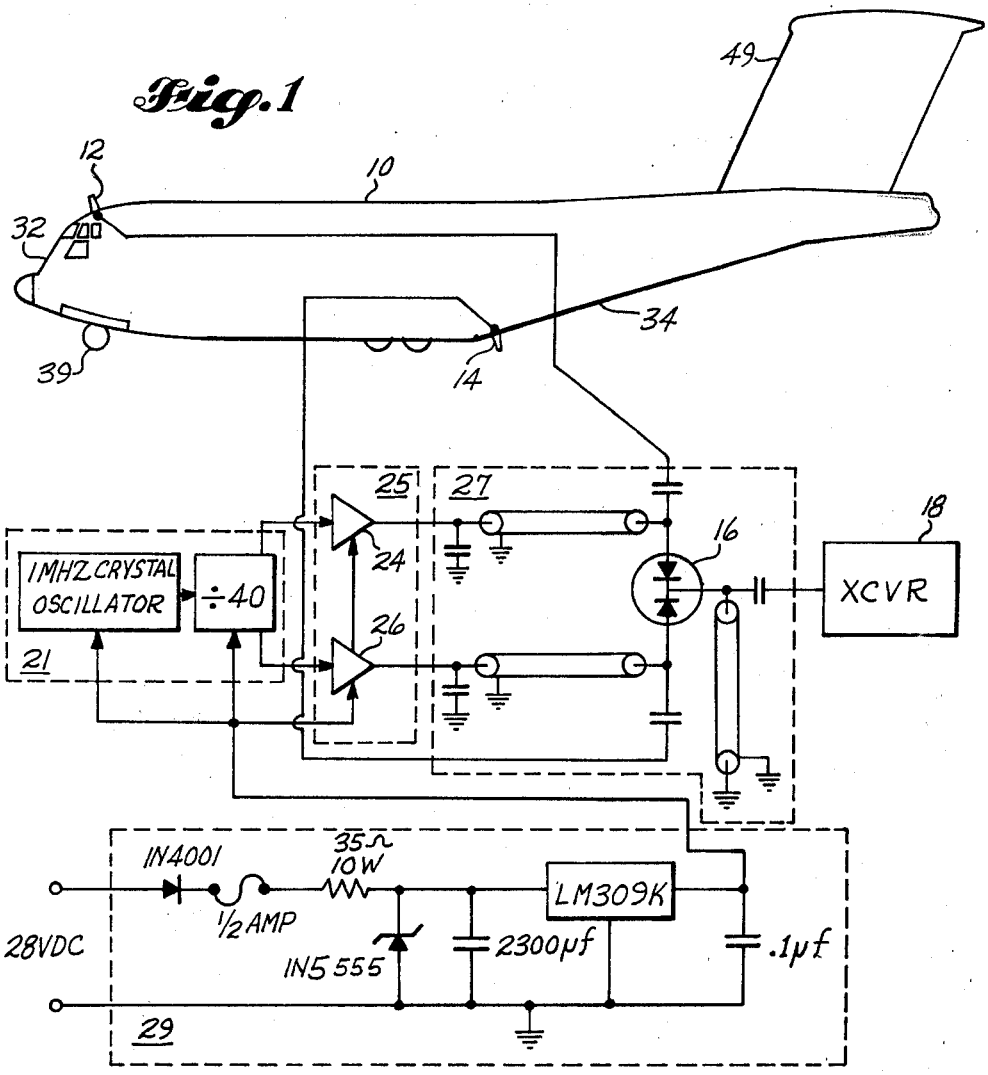
FIG. 1 is a simplified block diagram of an aircraft communication antenna system in accordance with a preferred embodiment of the present invention including a side view of the aircraft showing top and bottom fuselage mounted antennas.
Figure 5:
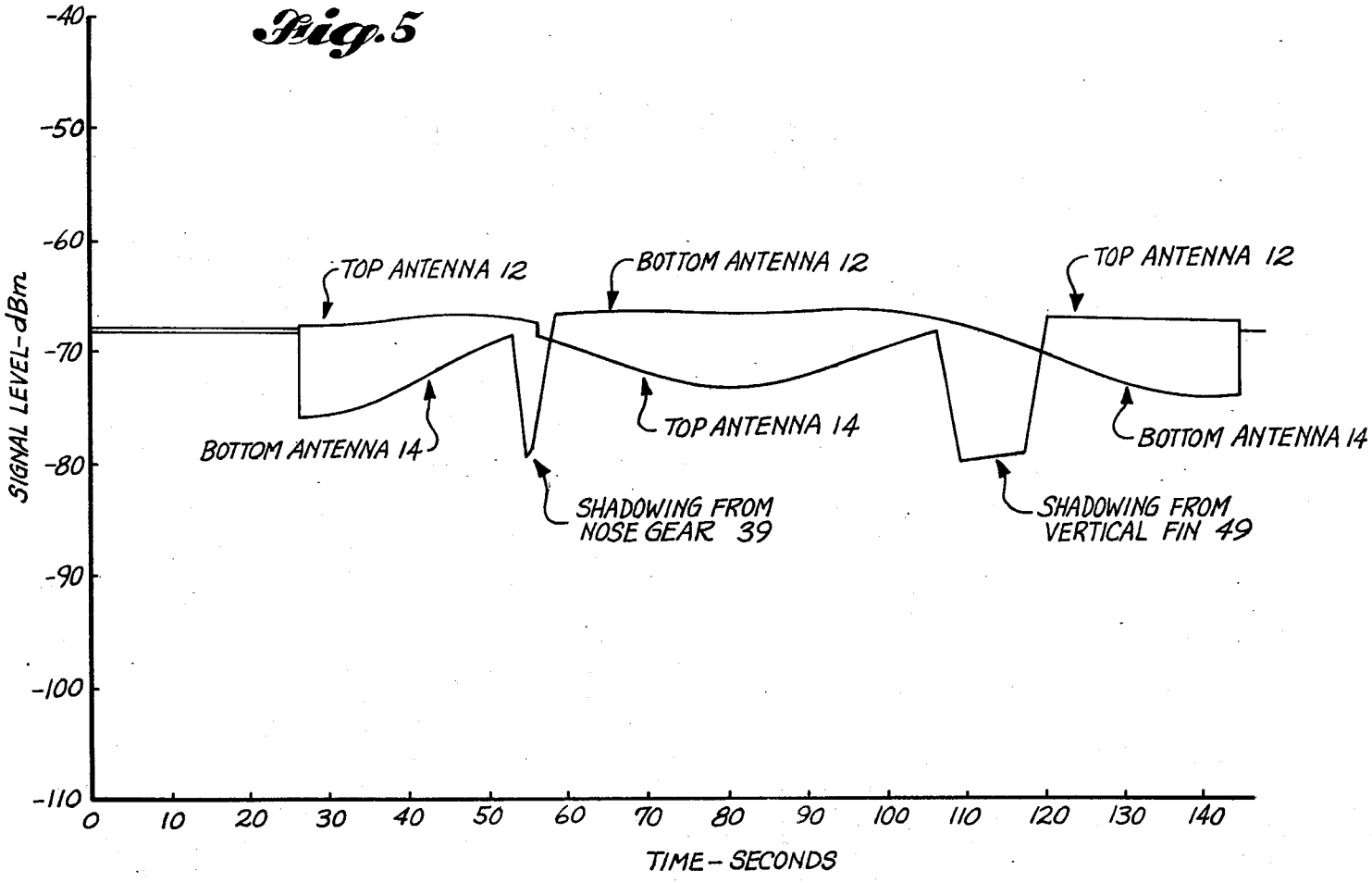
Figure 6:
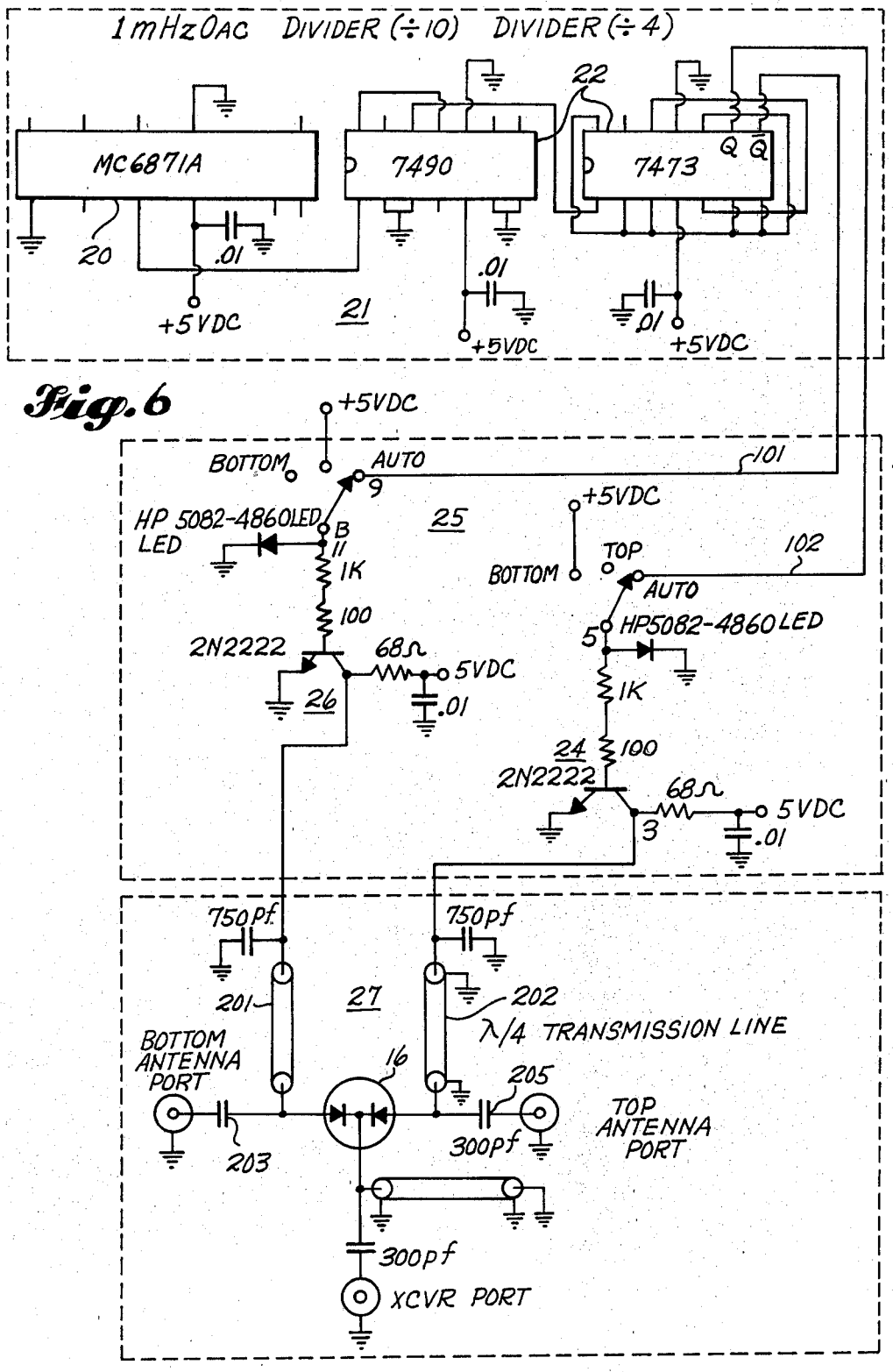

FIG. 5 is a graph illustrative of the resultant received signal strength utilizing either top or bottom antenna during a portion of the spiral descent path shown in FIG. 2; and, FIG. 6 is a schematic diagram of the switching circuit for providing commutation between top and bottom antennas shown in FIG. 1 and signals therefrom shown in FIG. 5 for eliminating signal strength variations caused by airframe structures shadowing.

Turning now to FIG. 1, mounted on the aircraft fuselage 10, there will be seen one quarter wavelength monopole antenna 12 at the top centerline of fuselage 10. Mounted on the bottom centerline of fuselage 10 is a one quarter wavelength monopole antenna 14. Top antenna 12 and bottom antenna 14 structures are blade type antennas for reduction of wind resistance thereon during high speed flight of the aircraft. A solid state pair of PIN diodes 16 (e.g., type MA 8334) capable of transmitting and receiving r.f. energy between antennas 12 and 14 and transceiver 18 are utilized as a lobing switch for alternating the signal path from transceiver 18 between top antenna 12 and bottom antenna 14 to achieve quasi continuous reception/transmission from the aircraft substantially free from shadowing of the aircraft.

A regulated power supply 29 provides 5 volts D.C. power to driver circuitry 25 comprising driver transistors 24 and 26 and sampling control rate circuit 21 comprising 1 MHz oscillator circuit 20 and divide by 40 circuit 22. Sampling control rate circuit 21 operating at 25 KHz rate though associated driver circuits 24 and 26 is utilized in r.f. circuit 27 to alternately bias diodes 16 in the respective receiving and transmitting modes between transceiver 18 and antenna pair 12 and 14.

It can be seen from FIG. 1 that top centerline mounted antenna 12 since disposed on a constricted front end portion 32 (portion having a cross sectional area less than the maximum cross sectional area portion of the fuselage) of fuselage 10 therefore provides some forward coverage below the horizon since the ground plane (aircraft skin) tilts downward toward the nose of the aircraft. Bottom rear centerline mounted antenna 14 since also disposed on a constricted however rear end portion 34 (portion having a cross sectional area less than the maximum cross sectional area portion of the fuselage) as a consequence provides some aft coverage above the horizon since the aircraft skin portion behind the antenna tilts upward (towards the center axis of the fuselage).

A top mounted fuselage antenna will have poor coverage in a banking maneuver which lifts the wing in the direction of the ground station. A bottom fuselage mounted antenna will be shadowed by the wing or fuselage or possibly landing gear as the aircraft banks toward the ground station. Selection of the best antenna is possible if a priori knowledge of the direction to the ground station is available. However, the direction of signal arrival is not always known. The switching (lobing) of two antennas 12 and 14 at a relatively high rate (at least twice the highest audio frequency) satisfies the Nyquist criteria. The upper limit audio frequency utilized in aircraft V.H.F. A.M. systems in about 3 KHz, and to satisfy the Nyquist criteria the audio as hereinbefore mentioned must be sampled at twice the highest frequency ($2\times3$ KHz$=6$ KHz) thus a 25 KHz rate utilized in accordance with the present system embodiment of the invention provides adequate reproduction of information content and quasi continuous reception/-transmission to the human ear. 25 KHz was above twice the highest frequency viz. 6 KHz and further enables placement of even harmonics on the 50 KHz channels of the V.H.F. A.M. band. With a duty cycle of $\frac{1}{2}$, the amplitude of the even numbered harmonics will be on the 50 KHz channels. The even harmonics have significantly lower amplitude than the odd harmonics. If one of the dual antenna system comprising antennas 12 and 14 has a deep null in a particular direction, the other antenna can fill in this null and provide continuous coverage. To illustrate how airframe shadowing is reduced by a type of commutation switching (hereinafter described) between antennas, a model of antenna patterns for top 12 and bottom 14 fuselage mounted blade type antennas is shown in FIGS. 3 and 4, respectively. With a spiral flight path descent profile as shown in FIG. 2, the received signal strengths from the ground station for top and bottom antennas 12 and 14 are shown as a function of time in seconds during the FIG. 2 descent path. The present system as shown in detail in FIG. 6 provides the aforementioned type of commutation between antennas 12 and 14 for reducing signal strength variations caused by structure shadowing attributable to each of the antennas individually as seen in FIG. 5.

Turning briefly back to FIG. 1 and regulated power supply 29 which is utilized to provide 5 volts in the system of FIG. 6 (shown in block form in FIG. 1), it will be observed that power required is aircraft 28 VDC power readily available aboard the aircraft. A zener diode IN5555 is utilized to clip high voltage spikes together with a low pass filter comprising the 35 ohm resistor and 2300 $\mu f$ capacitor. The aforementioned capacitor serves to provide power during power supply interruptions. LM309K is a 5 volt regulator which provides a regulated 5 volts for power supply variations at the input of supply 29 of from 7 volts to 25 volts. Returning to FIG. 6 and more particularly sampling rate circuit 21, a 1 MHz oscillator 20 (Motorola type MC6871A) will be seen to serve as the basic clock for the system of FIG. 6 and which possesses the stability and accuracy of a crystal oscillator. The measured frequency of oscillator 20 is 1000.0040 KHz which assures accurate placement of the switching products in the V.H.F. spectrum. Divide by 40 circuit 22 necessary to provide the 25 KHz switching rate comprises a 7490 decade divider followed downstream by a divide by four circuit 7473 which provides complementary outputs via leads 101 and 102 to driver transistor stages 24 and 26 since PIN diodes 16 require that one diode be forward biased while the other is unbiased.

R.F. circuit 27 utilizes quarter wavelength transmission line transformers 201 and 202 (type UT141 of 38.9 cm length) to reduce inductance and improve turn off characteristics of PIN diodes 16. One quarter wavelength transmission line transformers 201 and 202 are short circuited to ground by 300 p.f. silver mica capacitors at the ends remote from PIN diodes 16 so that one quarter wavelength away the aforementioned short circuit appears as an open circuit to the V.H.F. signal. The 300 p.f. silver mica capacitors 203 and 205 are actually series resonated with their lead inductances at the transceiver operating frequency of 120 MHz. Impedance measurements indicate capacitors 203 and 205 go through series resonance at 120 MHz, thus capacitors 203 and 205 are short circuits to the 120 MHz V.H.F. signals and transmission line transformers 201 and 202 appear as open circuits at V.H.F. while simultaneously providing low inductance paths for the bias currents. Capacitors 203 and 205 are open circuits to the bias currents. Driver circuitry 25 controlled by sampling control rate circuit 21 operating at a 25 KHz rate is utilized in r.f. circuit 27 to alternately bias diodes 16 so that the composite of signals received from top antenna 12 and bottom antenna 14 (as shown in FIG. 5) are provided to transceiver 18.

I claim:

1. An aircraft antenna system utilizing high frequency lobe switching between antennas for providing hemispherical coverage and reducing shadowing including:

a first one quarter wavelength blade antenna disposed on the top centerline of the fuselage of an aircraft for providing forward coverage below the horizon;

a second one quarter wavelength blade antenna disposed on the bottom centerline of the fuselage of an aircraft for providing aft coverage above the horizon; and a switching circuit coupled between said first one quarter wavelength blade antenna and said second one quarter wavelength blade antenna and adapted for coupling to utilization means, said switching circuit including a solid state lobing switch for alternating between said first one quarter wavelength blade antenna and said second one quarter wavelength blade antenna;

wherein said lobing switch is operative at a frequency exceeding that required to satisfy the Nyquist criteria for information transmitted and received by the antenna system, the operating frequency of said lobing switch exceeding 6 KHz; and, wherein the operating frequency of said lobing switch is 25 KHz.

* * * * *